US007213716B2

(12) United States Patent
Willim et al.

(10) Patent No.: US 7,213,716 B2
(45) Date of Patent: May 8, 2007

(54) CRANE

(75) Inventors: Hans-Dieter Willim, Ulm (DE); Uwe Frommelt, Ehingen (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 184 days.

(21) Appl. No.: 10/945,454

(22) Filed: Sep. 20, 2004

(65) Prior Publication Data

US 2005/0061761 A1 Mar. 24, 2005

(30) Foreign Application Priority Data

Sep. 18, 2003 (DE) ..... 203 14 503 U

(51) Int. Cl.
*B66C 23/34* (2006.01)

(52) U.S. Cl. ..... 212/298; 212/195; 212/299

(58) Field of Classification Search ..... 212/178, 212/195–198, 298, 299
See application file for complete search history.

(56) References Cited

U.S. PATENT DOCUMENTS

| | | | | |
|---|---|---|---|---|
| 2,068,397 | A * | 1/1937 | Chapman | 212/195 |
| 3,726,416 | A * | 4/1973 | Pottorff et al. | 212/178 |
| 3,955,684 | A | 5/1976 | Novotny et al. | |
| 3,963,133 | A * | 6/1976 | Gilli | 414/719 |
| 4,108,317 | A * | 8/1978 | Bifani et al. | 414/745.6 |
| 4,195,740 | A * | 4/1980 | Beduhn et al. | 212/235 |
| 4,286,720 | A * | 9/1981 | Atkinson | 212/178 |
| 4,729,486 | A * | 3/1988 | Petzold et al. | 212/302 |
| 6,065,620 | A * | 5/2000 | McGhie | 212/196 |
| 6,568,547 | B1 * | 5/2003 | Kretschmer et al. | 212/196 |
| 6,871,427 | B2 * | 3/2005 | Muta et al. | 37/466 |

FOREIGN PATENT DOCUMENTS

| | | |
|---|---|---|
| DE | 1209455 | 2/1962 |
| DE | 1809988 | 6/1970 |
| DE | 29823183 | 12/1997 |
| EP | 0779235 | 6/1997 |
| JP | 2001-164787 A * | 6/2001 |
| SU | 1463705 | 3/1989 |

* cited by examiner

*Primary Examiner*—Thomas J. Brahan
(74) *Attorney, Agent, or Firm*—Dilworth & Barrese, LLP.

(57) ABSTRACT

The within invention concerns a crane with a superstructure that rotates on a vertical axle, a boom coupled to the superstructure in such manner as to luff on a horizontal axle, luffing equipment for luffing the boom, and an operating ballast that counteracts the moment of the boom. According to the invention, the crane is characterized by an auxiliary erection frame that can be attached to the superstructure and/or the operating ballast in such manner as to project backward and can be connected with an auxiliary erection ballast for the erection of the boom.

19 Claims, 1 Drawing Sheet

CRANE

BACKGROUND OF THE INVENTION

The within invention concerns a crane with a superstructure that rotates on a vertical axle, a boom coupled to the superstructure in such manner that it can luff on a horizontal axle, luffing equipment for raising and lowering the boom, and an operating ballast that counteracts the moment of the boom.

The problem that arises in the erecting of very long booms is that booms lying on the ground have a very large lever arm and consequently induce a large moment. To equalize this moment, an appropriately heavy counter-ballast must be positioned on the crane if the boom is to be erected at all. On the other hand, in crane operation such a large ballast is often not necessary, since in specific applications the crane boom is continually operated in relatively steep luffing position. To permit the crane boom nevertheless to be erected with a proportionally smaller operating ballast, it has already been proposed to provide in front of the crane superstructure a supplemental bracing that prevents the crane from tipping forward when the boom is erected. However, such supplemental bracings usually necessitate the providing of appropriate base plates.

SUMMARY OF THE INVENTION

It is therefore the task of the within invention to create an improved crane of the type initially indicated, which avoids the disadvantages of the state of the art and develops said state of the art in an advantageous manner. Preferably, erection of even very long boom combinations should be achieved, without any need to provide ballast superfluous for operation.

According to the invention, this task is performed by a crane according to the description herein. Preferred embodiments of the invention are also the subject herein.

According to the invention, the crane is thus characterized by the presence of an auxiliary erection frame that can be attached to the superstructure and/or the operating ballast in such manner that it projects backward and can be connected with an auxiliary erection ballast for the erection of the boom. The auxiliary erection frame can be positioned on the back of the superstructure or on the operating ballast attached to said superstructure in such manner that it projects backward from the superstructure back side facing the boom and has an extended lever arm to which the auxiliary erection ballast can be attached. The auxiliary erection ballast is attached specially to the auxiliary erection frame for the erection of the boom and is removed for crane operation. The auxiliary erection frame creates for it a very large lever arm that prevents the crane from tipping forward when even long booms are erected.

In a further development of the invention, a preferably mobile auxiliary crane can be attached to the auxiliary erection frame, for use when the crane is assembled. For this purpose the auxiliary erection frame has appropriate attachment devices to which the auxiliary crane can be attached as auxiliary erection ballast. The advantage of using the mobile auxiliary crane, which actually serves for the erection of the crane, as supplementary erection ballast is that it eliminates the use of additional flatbeds that otherwise would be needed to transport additional revolving platform ballast to the construction site.

However, it is understood that other available supplemental ballast can if necessary be attached to the auxiliary erection frame as auxiliary erection ballast.

In a further development of the invention, for crane operation the auxiliary erection frame can be moved out of its backward-projecting position into another crane operation position in which the auxiliary erection frame rests essentially within the swivel area determined by the superstructure or the operating ballast attached thereto. The backward-projecting erection frame would be disruptive of crane operation, so it is advantageous if it can be moved from its backward-projecting erection position.

In particular, the erection frame can be coupled to swivel on the superstructure and/or the operating ballast, and by means of swivel equipment can be swung horizontally between the backward-projecting erection position and an operating position. Advantageously, the swivel axle on which the erection frame can be swiveled extends essentially horizontally in the area of the superstructure, so that the erection frame can be swiveled upward by means of the swivel equipment into said crane operating position. The swivel equipment can theoretically be designed in various ways. According to a preferred embodiment of the invention, there is at lest one hydraulic power lift for swiveling the auxiliary erection frame upward.

Advantageously, the erection frame can be fastened removably with removable fastening devices and can be disassembled. The erection frame can thereby be completely disassembled after the erection of the boom, so that during crane operation the erection frame does not create any disruptive effect of any kind. On the other hand the advantage of the above-described embodiment, in which the erection frame can be moved into an upward-swiveled crane operating position, is that the erection frame can be used as supplemental ballast.

In a further development of the invention, the attachment devices of the auxiliary erection frame, to which the auxiliary erection ballast can be attached, can have two attachment components positioned at adjustable intervals longitudinally along the auxiliary erection frame. The adjustable intervals of the attachment points permits the use of various large mobile auxiliary cranes as auxiliary erection ballast. In particular, the auxiliary cranes can be attached to their ground braces. Insofar as the intervals can vary for each mobile crane, the adjustable-interval design of the attachment components allows auxiliary cranes of various designs to be attached to the auxiliary erection frame. If necessary, the attachment components can however be positioned at permanent unchanged intervals on the auxiliary erection frame, if working with only one specific supplementary balance or mobile auxiliary crane is sufficient.

In a further development of the invention, the attachment components can be cross-members, at least one of which can assume different positions longitudinally on the auxiliary erection frame, preferably by sliding on the auxiliary erection frame. The cross-members project athwart and beyond the longitudinal direction of the auxiliary erection frame. They can have at their ends hooks or other appropriate attachment devices to which supporting or similar cables can be fastened for the attachment of the auxiliary erection ballast.

In a further development of the invention, the attachment devices of the auxiliary erection frame have height adjustment equipment to permit equalization of level differences between the crane and the auxiliary erection frame and the auxiliary erection ballast attached thereto, for example if the ground behind the crane is slightly uneven. The height adjustment equipment can be of various designs. Preferably, the height adjustment equipment is designed in such manner that the height of each attachment-device stop can be adjusted separately. In a further development of the invention, a threaded spindle can be positioned on each attachment device, with the help of which said threaded spindle the height of the attachment point can be adjusted.

To lighten the construction of the erection frame, theoretically a guying can be provided for the auxiliary erection frame, with which said guying the auxiliary erection frame is attached to the guying of the boom. In a further development of the invention, the erection frame can however also be attached free of guying to the superstructure. This facilitates erection. Guy cables or guy bars do not need to be assembled.

The length of the erection frame can vary. The erection-frame collar projecting backward above the operating ballast is preferably adapted to the length of the boom to be erected, so that an appropriate auxiliary erection ballast is sufficient. According to one embodiment of the invention, the auxiliary erection frame can have a collar projecting backward above the operating ballast and corresponding at least to the distance of the operating-ballast center of gravity from the superstructure axis of rotation.

BRIEF DESCRIPTION OF THE DRAWINGS

The invention is explained below in greater detail by means of a preferred embodiment and pertinent drawings that show.

DESCRIPTION OF THE PREFERRED EMBODIMENTS

Figure 1:
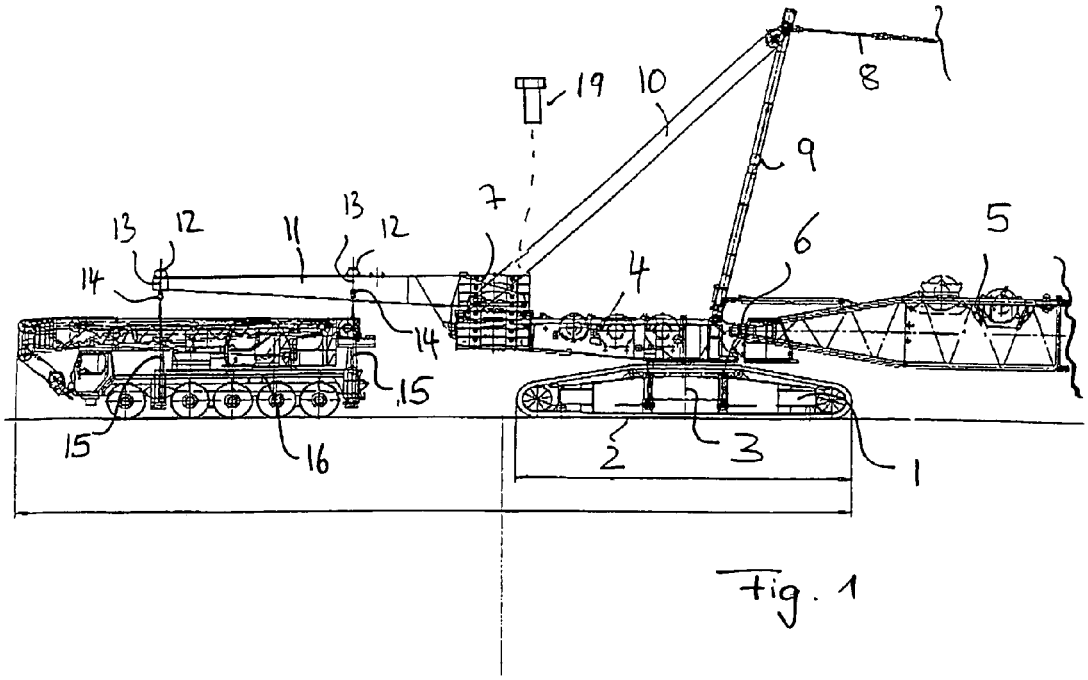
FIG. 1: A diagram side view of a crawler crane with rotating superstructure, on which a boom to be erected and still lying on the ground is coupled, with an auxiliary erection frame with its attached mobile auxiliary crane being attached to the back of the rotary platform as auxiliary erection ballast.

The crane shown in the figures has a substructure 1, 1A with an undercarriage 2, 2A designed as a crawler undercarriage in the embodiment illustrated and having two crawler tracks positioned to right and left. A rotary platform or a superstructure 4, 4A that can rotate on a vertical swivel axis 3, 3A is housed on substructure 1. Superstructure 4, 4A has a boom 5, 5A articulated on a horizontal luffing axle 6, 6A to the superstructure 4, 4A and permits a hosting cable to run over its tip in the usual manner.

On the superstructure 4, 4A back side facing the articulation position of boom 5, 5A the superstructure 4, 4A has an operating ballast 7, 7A that counters the tipping moment induced by boom 5, 5A or a load hanging thereon.

Boom 5, 5A can be luffed up and down on the luffing axle 6, 6A by means of a guying 8, 8A, and can be erected from the position illustrated in the drawings. Guying 8, 8A is led over a support boom 9, 9A in order to give guying 8, 8A a more advantageous hoisting arm. Support boom 9, 9A can be swiveled on an axle parallel to luffing axle 6, 6A. The guying is led in known manner via several reeved adjustment cables 10, 10A in the area of operating ballast 7, 7A to the superstructure.

To permit erection of the sometimes very long boom 5, 5A from the ground position illustrated in the figures with only limited operating ballast, which actually would be too narrow for the purpose, an auxiliary erection boom 11, 11A is bolted with locking bolts 19 to the back of superstructure 4, 4A. Auxiliary erection frame 11, 11A consists preferably of two parallel longitudinal supports welded together by means of several cross-profiles. It is understood that auxiliary erection frame 11, 11A could however also be designed as lattice girders or other form. When the crane is lying flat, auxiliary erection frame 11, 11A, essentially horizontal, extends backward, at essentially the height of the top of superstructure 4, 4A. In all cases auxiliary erection frame 11, 11A is positioned at a sufficient height to permit a mobile auxiliary crane used for the assembly of the crane to be moved under it.

Cross-members 12, 12A positioned on the top of auxiliary erection frame 11, 11A project sideways over auxiliary erection frame 11 and can be adjustably positioned longitudinally on said auxiliary erection frame 11, 11A. The cross-members 12 can for example be housed to slide along the auxiliary erection frame 11, 11A and can be fixed in various positions. At the ends of cross-members 12, 12A there are vertically-acting threaded spindles 13, 13A that support attachment devices designed for example in the form of hooks, to which steel cables for the attachment of the auxiliary erection ballast can be attached. With the help of threaded spindles 13, 13A the height of the attachment-device 14, 14A stop can be adjusted so that differences in level between auxiliary erection frame 11, 11A and the ground below can be equalized.

As shown in FIG. 1, cross-members 12, 12A are advantageously positioned at intervals such that their distance from one another corresponds to the distance of auxiliary-crane ground supports. The ground supports extended sideways out of the auxiliary crane are attached by means of steel cables 15, 15A to the cross-members 12, 12A, so that the auxiliary crane forms an auxiliary erection ballast 16, 16A.

Figure 2:
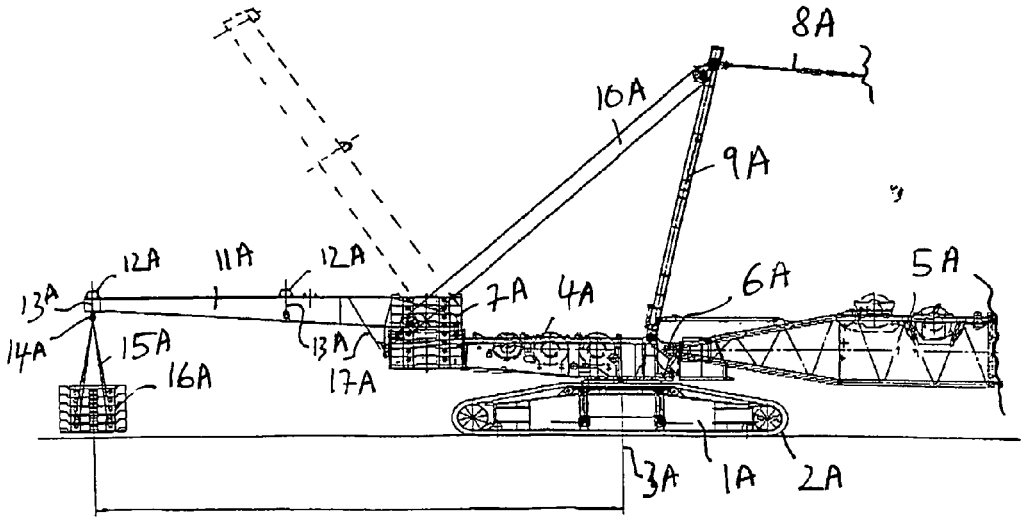
FIG. 2: A diagram side view of the crane of FIG. 1, with an ordinary plate ballast instead of the auxiliary crane being attached to the auxiliary erection frame as auxiliary erection ballast.

It is understood that instead of the mobile auxiliary crane, a separate supplementary ballast can also be attached, as shown in FIG. 2.

Theoretically the auxiliary erection frame 11, 11A can be rigidly bolted to superstructure 4, 4A, so that it assumes the erection position shown in the figures. For the operation of the crane, the auxiliary erection frame is then unbolted and removed. Operating ballast 7, 7A is sufficient by itself for the operation of the crane, particularly when the crane is operated only with steeply erected boom.

In an alternative embodiment of the invention, auxiliary erection frame 11, 11A can also be housed to swivel on superstructure 4, 4A and specifically advantageously on an axle parallel to luffing axle 6, 6A. A swivel drive 17 for example in the form of an hydraulic power lift can be positioned on auxiliary erection frame 11, 11A, with the help of which the auxiliary erection frame 11, 11A can be swiveled upward out of essentially horizontal, backward projecting erection position into operating position, illustrated by the broken line in FIG. 2. In upward swiveled operating position, auxiliary erection frame 11, 11A is swiveled upward at least far enough that it can swivel past obstructions on the ground. Preferably, auxiliary erection frame 11, 11A can be swiveled upward far enough that it comes to rest within the swivel range defined by the back edge of superstructure 4, 4A. In comparison to FIG. 2, the auxiliary erection frame could be swiveled slightly farther upward. In order not to collide with the adjustment cabling 10, 10A, the auxiliary erection frame can have a U-profile in the area of its articulation, so that the cabling can pass between the two legs.

The invention claimed is:

1. Crane with a superstructure (4) having a forward end and a backward end that rotates on a vertical axle (3), a boom (5) coupled to the superstructure (4) and extending beyond the forward end thereof in such manner that it can luff on a horizontal axle (6), a luffing device (8, 9, 10) for luffing the boom (5), and an operating ballast (7) positioned at the backward end of the superstructure (4) that counteracts the moment of the boom, and an additional, separate auxiliary erection frame (11) that is attached, free of guying to the superstructure (4) and/or the operating ballast (7) in such manner that it is movable between a first position wherein it projects backward from the luffing device (8,9,10) and is connected with an auxiliary erection ballast (16) for the erection of the boom (5) and an upward, operating second position wherein it is not connected with the auxiliary erection ballast (16).

2. Crane according to the claim 1, in which the auxiliary erection frame (11) has attachment equipment (14) for attaching a mobile auxiliary crane as the auxiliary erection ballast (16).

3. Crane according to claim 2, in which the attachment equipment (2) has attachment components (14) positioned at adjustable intervals longitudinally along the auxiliary erection frame (11).

4. Crane according to claim 3, in which the attachment equipment (14) of the auxiliary erection frame (11) has a height adjustment device (13) positioned on each attachment component (14).

5. Crane according to claim 2, in which the attachment components (14) are supported by cross-members (12), at least one of which can assume different positions longitudinally along the auxiliary erection frame (11).

6. Crane according to claim 5, in which the attachment equipment (14) of the auxiliary erection frame (11) has a height adjustment device (13) positioned on each attachment component (14).

7. Crane according to claim 2, in which the attachment equipment (14) of the auxiliary erection frame (11) has a height adjustment device (13) positioned on each attachment component (14).

8. Crane according to claim 1, including attachment equipment (2) having attachment components (14) positioned at adjustable intervals longitudinally along the auxiliary erection frame (11).

9. Crane according to claim 8, in which the attachment components (14) are supported by cross-members (12), at least one of which can assume different positions longitudinally along the auxiliary erection frame (11).

10. Crane according to claim 9, in which the attachment equipment (14) of the auxiliary erection frame (11) has a height adjustment device (13) positioned on each attachment component (14).

11. Crane according to claim 8, in which the attachment equipment (14) of the auxiliary erection frame (11) has a height adjustment device (13) positioned on each attachment component (14).

12. Crane according to claim 8, in which the attachment components (14) are supported by cross-members (12), at least one of which can assume different positions longitudinally along the auxiliary erection frame (11).

13. Crane according to claim 8, in which the attachment equipment (14) of the auxiliary erection frame (11) has a height adjustment device (13) positioned on each attachment component (14).

14. Crane according to claim 1, in which for operation of the crane the erection frame (11) can be moved out of its backward-projecting erection position into a crane operation position in which the auxiliary erection frame (11) rests essentially within a swivel area defined by the superstructure (4).

15. Crane according to claim 1, in which the auxiliary erection frame (11) is coupled, on an essentially horizontal axle, to the superstructure (4) and/or operating ballast (7) in such manner that it can swivel, and can swing horizontally by swivel equipment (17), including a hydraulic power lift, between its backward-projecting erection position and an upward-swiveled operating position.

16. Crane according to claim 1, in which the auxiliary erection frame (11) is fastened by removable fastening bolts.

17. Crane according to claim 1, in which the auxiliary erection frame (11) has an overhanging length that projects backward from the operating ballast (7), wherein the overhanging length equals or exceeds the distance of the operating-ballast center of gravity from the superstructure rotation axle (3).

18. Crane according to claim 1, wherein the auxiliary erection frame (11) is structured and arranged to be detached from the ballast (7) during lifting of load by the boom (5).

19. Crane according to claim 18, wherein the auxiliary erection frame (11) is additionally structured and arranged to be swiveled upwardly during load lifting.

* * * * *